United States Patent [19]

Höhr et al.

[11] Patent Number: 4,596,581

[45] Date of Patent: Jun. 24, 1986

[54] CARBOXYL- AND AMINO-CONTAINING COPOLYMER FOR AFTER-TANNING MINERAL TANNED LEATHER

[75] Inventors: Lothar Höhr, Worms; Dietrich Lach, Friedelsheim; Rolf Streicher, Worms, all of Fed. Rep. of Germany

[73] Assignee: BASF Aktiengesellschaft, Ludwigshafen, Fed. Rep. of Germany

[21] Appl. No.: 732,808

[22] Filed: May 10, 1985

Related U.S. Application Data

[63] Continuation of Ser. No. 454,278, Dec. 29, 1982, abandoned.

[30] Foreign Application Priority Data

Jan. 16, 1982 [DE] Fed. Rep. of Germany ..... 3201226

[51] Int. Cl.[4] ..... C14C 3/22

[52] U.S. Cl. ..... 8/94.21; 8/94.2; 8/94.33

[58] Field of Search ..... 8/94.21, 94.33

[56] References Cited

U.S. PATENT DOCUMENTS

| | | | |
|---|---|---|---|
| 2,138,763 | 11/1938 | Graves | 526/312 |
| 2,592,107 | 4/1952 | Azorlosa | 525/339 |
| 2,942,930 | 6/1960 | Luvisi et al. | 8/94.33 |
| 3,103,447 | 9/1963 | Lowell et al. | 427/402 |
| 3,744,969 | 7/1973 | Alps et al. | 8/94.21 |
| 4,314,800 | 2/1982 | Monsheimer et al. | 8/94.33 |
| 4,390,340 | 6/1983 | Lach | 8/94.24 |
| 4,439,201 | 3/1984 | Lauton et al. | 8/436 |

FOREIGN PATENT DOCUMENTS

| | | | |
|---|---|---|---|
| 0061420 | 9/1982 | European Pat. Off. | 8/94.21 |
| 77495 | 4/1983 | European Pat. Off. . | |
| 530643 | 12/1940 | United Kingdom | 8/94.33 |

*Primary Examiner*—A. Lionel Clingman

*Attorney, Agent, or Firm*—Oblon, Fisher, Spivak, McClelland & Maier

[57] ABSTRACT

An amino-containing and carboxyl-containing polymer tanning agent containing more carboxyl groups than amino groups, when used for retanning mineral-tanned leather, gives, alone or in combination with conventional anionic retanning agents, leather which is readily dyeable and has good sensory properties.

1 Claim, No Drawings

CARBOXYL- AND AMINO-CONTAINING COPOLYMER FOR AFTER-TANNING MINERAL TANNED LEATHER

This application is a continuation of application Ser. No. 454,278 filed Dec. 29, 1982, now abandoned.

Tanning is conventionally carried out using mineral tanning agents, e.g. basic chromium, aluminum and/or zirconium salts, either alone or in combination with synthetic tanning agents.

Retanning with natural or synthetic tanning agents serves to improve the sensory properties of the leather, e.g. handle, softness, nature of the grain, and fullness. Thus, this is not tanning in the strict sense of the word, i.e. the shrinking temperature of the leather is as a rule not greatly increased in this procedure. Examples of tanning agents used for retanning are syntans, i.e. water-soluble condensates of, for example, naphthalenesulfonic acid and formaldehyde or of phenolsulfonic acid, formaldehyde and urea, and ligninsulfonic acids, and for the past few years also water-soluble polymers and copolymers based on acrylic acid and other unsaturated polymerizable carboxylic acids, as a rule in combination with the above syntans. They are all anionic, with the result that the dyeings obtained with the conventional anionic dyes are lightened to varying extents.

Tanning agents as disclosed in German Laid-Open Application DOS No. 2,843,233 offer progress in this connection. These tanning agents, in contrast to conventional syntans, contain small amounts of aromatic amines as condensed units. Although these products, when used alone for retanning, impart good dyeing properties to the leather, they are not capable of deepening dyeings on leather retanned with conventional syntans. Moreover, they are less effective in producing fullness than the commercial polymer tanning agents based on acrylic acid or methacrylic acid.

It is an object of the present invention to provide a tanning process which avoids these disadvantages, i.e. a process which imparts advantageous dyeing properties and good fullness to the leather even when anionic tanning agents and retanning agents are used.

We have found that this object is achieved by a retanning process as defined in the claims.

The polymer tanning agent employed according to the invention must be water-soluble, i.e. it should be possible to prepare not less than 2, preferably not less than 10% strength by weight aqueous solutions under the conditions conventionally employed in retanning (pH 3.5–6, preferably 4–5.5, and 10°–70° C., preferably 30°–45° C.). It is not absolutely necessary in this process for the polymer to be completely dissolved to give a true (clear) solution, a colloidal (more or less cloudy) solution also being adequate. However, true solutions are preferred. The amount of polymer tanning agent employed is from 0.025 to 2.5%, preferably from 0.25 to 1.6%, based on shaved weight.

For economic reasons, particularly suitable carboxyl-containing monomers are acrylic acid, methacrylic acid, and maleic acid and its anhydride, but other compounds, e.g. itaconic acid and crotonic acid, may also be used. The proportion of carboxyl groups present in salt form in the aqueous solution varies, depending on the pH. The type of cation is of virtually no importance, the most commonly used ones being sodium, potassium and in particular ammonium ions. Suitable ammonium ions are also mono-, di- and trialkylammonium ions where alkyl is of 1 to 6 carbon atoms.

The manner in which the amino group is bonded to the polymer is substantially unimportant for the purposes of the invention. In the main, there are two possible ways of incorporating this group into the polymer. In the first case, an amino-containing, copolymerizable monomer is incorporated as copolymerized units, while in the second case a $C_1$–$C_4$-dialkylamino-$C_2$–$C_6$-alkylamine is added at copolymerized units of maleic anhydride to form the corresponding amide-acid (also referred to as a half-amide because the anhydride group is converted to a carboxyl group and an amide group). Examples of suitable compounds for this procedure are 2-dimethylaminoethylamine, 2-diethylaminoethylamine, 2-diisopropylaminoethylamine, 2-dibutylaminoethylamine, 3-dimethylaminopropylamine, 3-diethylaminopropylamine, 1-diethylamino-4-amino-pentane and dimethylaminoneopentylamine (N,N,2,2-tetramethyl-1,3-propanediamine). Instead of a dialkylaminoalkylamine, a $C_1$–$C_4$-dialkylamino-$C_2$–$C_6$-alkanol, e.g. 2-dimethylaminoethanol, 2-diethylaminoethanol, 2-dibutylaminoethanol, 1-dimethylaminopropan-2-ol, 1-dimethylaminopropan-3-ol or 2,2-dimethyl-3-dimethylaminopropan-1-ol, may also be added at the anhydride group to form the corresponding ester-acid (half-ester). It is also possible to react part of the maleic anhydride units with ammonia, an amine or an alcohol in order to establish the desired ratio of the number of carboxyl groups to the number of amino groups.

Particularly suitable amino-containing copolymerizable monomers are those of the general formula

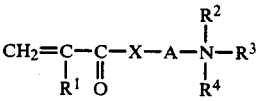

where X is 0 or, preferably -N($R^5$)-, A is straight-chain or branched alkylene of 2 to 6 carbon atoms, $R^1$, $R^2$, $R^3$, $R^4$ and $R^5$ are each H or alkyl of 1 to 4 carbon atoms, $R^4$ may furthermore be benzyl, and $R^2$ and $R^3$ together may furthermore be alkylene, which together with the nitrogen atom forms a 5-membered or 6-membered ring. N-(3-dimethylaminopropyl)-methacrylamide is particularly preferred. Examples of suitable compounds are dimethylaminoneopentyl acrylate, dimethylaminoethyl acrylate and dimethylaminoethyl methacrylate, although these are less preferable owing to their sensitivity to hydrolysis. In principle, other copolymerizable monomers containing tertiary or quaternary amino groups can also be used, but for economic reasons most of these are less suitable for this purpose.

Tertiary amino groups are preferred. If it is desired to quaternize these amino groups (although as a rule this is of no particular advantage), this can be carried out by polymer-analogous reaction of the polymer containing tertiary amino groups with a conventional quaternizing agent, e.g. dimethyl sulfate, diethyl sulfate, benzyl chloride, methyl iodide, etc., or by quaternizing the tertiary amino group in the amino-containing copolymerizable monomer before polymerization.

Other suitable non-ionic comonomers are, in particular, acrylonitrile and acrylamide, as well as, for example, styrene, methacrylonitrile, methacrylamide, vinyl acetate, vinyl chloride, vinylidene chloride, butadiene, ethylene, and acrylates and methacrylates of alcohols of 1 to 8 carbon atoms. For copolymerization with maleic anhydride, particularly suitable compounds are styrene, diisobutene and tetraisobutene, but vinyl acetate and vinyl propionate may also be used.

The polymers are obtained in a conventional manner by copolymerization in aqueous or organic solution, in dispersion or in the absence of a solvent, using a conventional free-radical initiator, e.g. a peroxide or azodiisobutyronitrile.

The polymer has a Fikentscher K value (Cellulose-Chemie, 13 (1932), 58–64 and 71–74) of from 15 to 80, preferably from 20 to 60, measured at 60° C. in a mixture of 60 parts of dimethylformamide and 40 parts of glacial acetic acid, at a concentration of 1 g/100 ml.

The ratio of the number of amino groups to the number of acid groups in the novel polymer tanning agent should be from 1:20 to 17:20, preferably from 1:8 to 1:2, and the content of carboxyl groups should be from 6 to 40, preferably from 12 to 30% by weight, based on the total polymer. The term "carboxyl groups" is intended here to include carboxylate groups.

Retanning according to the invention can be carried out as a separate operation or together with the dyeing and fatliquoring. As stated above, it is possible, and even preferable, to combine it with or carry it out subsequently to a conventional retanning, i.e. one in which anionic retanning agents are used.

The polymer tanning agents employed according to the invention impart a good fullness and, especially, good dyeing properties in the leather. As stated above, polymer tanning agents are conventionally employed in combination with syntans. As a rule, it is found that this combination lightens the dyeing to an even greater extent than when the syntan is used alone. The novel polymer tanning agents do not have this disadvantage, and, depending on the type of amino-containing monomer employed, it is even possible to achieve a more or less substantial deepening of color in comparison with the dyeing on the leather after-treated only with a syntan. Regarding this color-deepening effect, the novel polymer tanning agents, surprisingly, are substantially superior to the amino-containing syntans disclosed in German Laid-Open Application DOS No. 2,843,233. This is surprising in particular because the number of carboxyl groups in the novel polymer tanning agent exceeds the number of amino groups. As a rule, better fullness and better lightfastness are also obtained.

In the Examples which follow, parts and percentages are based on shaved weight, unless stated otherwise or evident to the contrary from the context.

The starting materials mentioned in the Examples, except for the novel polymer tanning agents, are commercially available. The polymerizations were carried out under a protective nitrogen gas atmosphere.

EXAMPLE 1

In a reaction vessel equipped with a reflux condenser and a stirrer, 32 parts of methacrylic acid, 18 parts of dimethylaminopropylmethacrylamide, 60 parts of acrylonitrile, 80 parts of dimethylformamide and 20 parts of acetone were mixed, the mixture was heated to 85° C. and 4 parts of azoisobutyrodinitrile (AIBN) were added in the course of 1 hour. The internal temperature increased to 120° C. during the addition. Polymerization was continued for 1 hour at 120° C., after which the mixture was cooled and then brought into solution by adding 30 parts of 20% strength aqueous $NH_3$ solution and 356 parts of water. A solution with a solids content of 22.3% was obtained.

The resulting solution was employed for retanning as follows: first, 100 parts of chrome leather moist from the hair-shaving process, in 100 parts of water, were neutralized at 30° C. with 1 part of sodium formate and 0.4 part of sodium bicarbonate. Thereafter, drumming was carried out in 100 parts of fresh aqueous liquor at 40° C., using 1 part of a commercial neutralized dyeing assistant based on phenolsulfonic acid, for 20 minutes, after which 7 parts of tanning agent solution obtained as described above were added. Drumming was carried out for a further 40 minutes, after which a further 4 parts of a commercial phenol-based replacement tanning agent was added to the liquor, and drumming was carried out for a further 60 minutes. 1 part of Acid Brown 161 dye was then added, and drumming was continued for a further 30 minutes, after which the leather was fat-liquored with 6 parts of a commercial fat liquor based on natural fat. Finally, acidification was effected with 1 part of formic acid.

For comparison, following exactly the same method, a second leather was retanned, dyed and fat-liquored, using, instead of the novel retanning agent, a commercial polymer tanning agent based on acrylic acid/acrylonitrile. The leather treated according to the invention was found to be substantially more deeply dyed.

EXAMPLE 2

In a reaction vessel equipped with a reflux condenser and a stirrer, 27 parts of acrylic acid, 18 parts of dimethylaminopropylmethacrylamide, 40 parts of acrylonitrile, 80 parts of dimethylformamide and 20 parts of acetone were mixed, the mixture was heated to 85° C. and 4 parts of AIBN were added in the course of 1 hour. The internal temperature increased to 115° C. during the addition. Polymerization was continued for 1 hour at 115° C., after which the mixture was cooled and then brought into solution using 30 parts of 20% strength aqueous $NH_3$ solution and 356 parts of water. A solution with a solids content of 19.2% was obtained.

The resulting solution was employed for retanning as follows: first, 100 parts of chrome leather moist from the hair-shaving process, in 100 parts of water, were neutralized at 30° C. with 1 part of sodium formate and 0.3 part of sodium bicarbonate. Thereafter, drumming was carried out in 100 parts of fresh aqueous liquor at 40° C., using 2 parts of a commercial neutralized auxiliary tanning agent based on naphthalenesulfonic acid, for 20 minutes, after which 9 parts of the tanning agent solution obtained as described above were added to the liquor, and drumming was carried out for a further 60 minutes. Dyeing was effected in the same liquor, using 1 part of Acid Brown 165, and the leather was then fatliquored with 5 parts of a commercial combination liquor. Finally, acidification was effected with 1 part of formic acid.

For comparison, following exactly the same method, a second leather was retanned, dyed and fatliquored, using, instead of the novel retanning agent, the tanning agent described in German Laid-Open Application DOS No. 2,843,233, Example 1. The leather treated with the novel tanning agent was once again found to be substantially more deeply dyed.

EXAMPLE 3

In a reaction vessel equipped with a reflux condenser and a stirrer, 56 parts of acrylonitrile, 18 parts of dimethylaminopropylmethacrylamide, 27 parts of acrylic acid, 38 parts of acetic acid and 1.3 parts of potassium peroxydisulfate were dissolved in 509 parts of water, and the solution was heated to 85° C. After 2 hours, a coarse-particled dispersion having a solids content of 13.4% was obtained. This dispersion was converted into a solution by adding $NH_3$ until a weakly basic reaction was obtained.

The resulting tanning agent was employed as described in Example 2, and a very deeply dyed leather was obtained.

EXAMPLE 4

In a reaction vessel equipped with a reflux condenser and a stirrer, 52 parts of styrene and 49 parts of maleic anhydride were dissolved in 300 parts of dimethylformamide, and the solution was heated to 85° C. 3 parts of AIBN were added in the course of one hour. The reaction was allowed to continue for two hours at 85° C., after which a mixture of 45.8 parts of dibutylamine and 24.5 parts of dimethylaminopropylamine was added slowly. The mixture was kept at 85° C. for a further hour, and thereafter water was added and the mixture rendered weakly basic with $NH_3$.

The tanning agent solution was employed as described in Example 2, and a deeply dyed leather was obtained.

EXAMPLE 5

In a reaction vessel equipped with a reflux condenser and a stirrer, 27 parts of acrylic acid, 18 parts of dimethylaminopropylmethacrylamide, 60 parts of butyl acrylate, 80 parts of dimethylformamide and 20 parts of acetone were mixed, the mixture was heated to 85° C. and 1.5 parts of AIBN were added in the course of 2 hours. The internal temperature increased to 87° C. during the addition. Polymerization was continued for 1 hour, after which the mixture was cooled and then brought into solution using 30 parts of 20% strength aqueous $NH_3$ solution and 370 parts of water. A solution with a solids content of 16.4% was obtained.

This solution was used similarly to Example 2, and the leather thus obtained was found to be very deeply dyed.

EXAMPLE 6

In a reaction vessel equipped with a reflux condenser and a stirrer, 27 parts of acrylic acid, 18 parts of dimethylaminopropylmethacrylamide, 60 parts of 2-ethylhexyl acrylate, 80 parts of dimethylformamide and 20 parts of acetone were mixed, the mixture was heated to 85° C. and 1.5 parts of AIBN were added in the course of 2 hours. The internal temperature increased to 86° C. during the addition. Polymerization was continued for 1 hour, after which the mixture was cooled and then brought into solution using 30 parts of 20% strength aqueous $NH_3$ solution and 390 parts of water. A solution with a solids content of 12.1% was obtained.

This solution was used similarly to Example 2, and the leather thus obtained was found to be deeply dyed.

EXAMPLE 7

In a reaction vessel equipped with a reflux condenser and a stirrer, 27 parts of acrylic acid, 18 parts of dimethylaminopropylmethacrylamide, 65 parts of acrylonitrile and 80 parts of dimethylformamide were mixed, the mixture was heated to 85° C. and 4 parts of AIBN were added in the course of 1 hour. The internal temperature increased to 126° C. during the addition. Polymerization was continued for 0.5 hour at this temperature, after which the mixture was cooled and the product was brought into solution using 30 parts of 20% strength aqueous $NH_3$ solution and 540 parts of water. A solution with a solids content of 16.5% was obtained.

This solution was used similarly to Example 2, and the leather thus obtained was found to be very deeply dyed.

EXAMPLE 8

In a reaction vessel equipped with a reflux condenser and a stirrer, 27 parts of acrylic acid, 18 parts of dimethylaminopropylmethacrylamide, 60 parts of methyl methacrylate, 80 parts of dimethylformamide and 20 parts of acetone were mixed, the mixture was heated to 85° C. and 1.5 parts of AIBN were added in the course of 2 hours. The internal temperature increased to 86° C. during the addition. Polymerization was continued for 1 hour, after which the mixture was cooled and then brought into solution using 30 parts of 20% strength aqueous $NH_3$ solution and 380 parts of water. A solution with a solids content of 16.5% was obtained.

This solution was used similarly to Example 2, and the leather thus obtained was found to be dyed in a full shade.

EXAMPLE 9

In a reaction vessel equipped with a reflux condenser and a stirrer, 27 parts of acrylic acid, 18 parts of dimethylaminopropylmethacrylamide, 55 parts of acrylonitrile, 70 parts of dimethylformamide and 17 parts of acetone were mixed, the mixture was heated to 85° C. and 3.5 parts of AIBN were added in the course of 1 hour. The internal temperature increased to 120° C. during the addition. Polymerization was continued for 1 hour, after which the mixture was cooled and then brought into solution by the addition of 26 parts of 20% strength aqueous $NH_3$ solution and 312 parts of water. A solution with a solids content of 24.1% was obtained.

This solution was used similarly to Example 2, and the leather thus obtained was found to be dyed in a deep hue.

EXAMPLE 10

In a reaction vessel equipped with a reflux condenser and a stirrer, 27 parts of acrylic acid, 18 parts of dimethylaminopropylmethacrylamide, 60 parts of acrylonitrile and 80 parts of dimethylformamide were mixed, the mixture was heated to 85° C. and 4 parts of AIBN were added in the course of 1 hour. The internal temperature increased to 125° C. during the addition. Polymerization was continued for 0.5 hour, after which the mixture was cooled and then brought into solution by the addition of 30 parts of 20% strength aqueous $NH_3$ solution and 540 parts of water. A solution with a solids content of 14.2% was obtained.

This solution was used similarly to Example 2, and the leather thus obtained was found to be dyed in a deep hue.

EXAMPLE 11

In a reaction vessel equipped with a reflux condenser and a stirrer. 27 parts of acrylic acid, 18 parts of dimethylaminoethyl acrylate, 55 parts of acrylonitrile, 4 parts of acrylamide, 80 parts of dimethylformamide and 20 parts of acetone were mixed, the mixture was heated to 85° C. and 4 parts of AIBN were added in the course of 1 hour. The internal temperature increased to 110° C. during the addition. Polymerization was continued for 1 hour, after which the mixture was cooled and then brought into solution by the addition of 30 parts of 20% strength aqueous $NH_3$ solution and 356 parts of water. A solution with a solids content of 21.3% was obtained.

This solution was used similarly to Example 2, and the leather thus obtained was found to be dyed in a deep hue.

EXAMPLE 12

In a reaction vessel equipped with a reflux condenser and a stirrer, 21.7 parts of acrylic acid, 12.7 parts of dimethylaminoneopentyl acrylate, 65.9 parts of styrene and 70 parts of isopropanol were mixed, the mixture was heated to 85° C. and 7.6 parts of AIBN were added in the course of 0.7 hour. The internal temperature increased to 87° C. during the addition. Polymerization was continued for 1.5 hours, after which the mixture was cooled and then brought into solution by the addition of 25 parts of 20% strength aqueous $NH_3$ solution and 370 parts of water. A solution with a solids content of 20.1% was obtained.

This solution was used similarly to Example 2, and the leather thus obtained was found to be dyed in a full shade.

EXAMPLE 13

In a reaction vessel equipped with a reflux condenser and a stirrer, 61 parts of acrylonitrile, 30 parts of acrylic acid, 9.6 parts of dimethylaminopropylmethacrylamide, 80 parts of dimethylformamide and 20 parts of acetone were mixed, the mixture was heated to 75° C. and 4 parts of AIBN were then added in 4 portions in the course of 60 minutes. Polymerization was continued for one hour at 75° C., after which the mixture was cooled and then dissolved in a mixture of 286 parts of water and 30 parts of concentrated aqueous ammonia solution ($NH_3$). A solution with a solids content of 18.7% was obtained.

This solution was used similarly to Example 2, and the leather thus obtained was found to be dyed in a full shade.

EXAMPLE 14

In a reaction vessel equipped with a reflux condenser and a stirrer, 48 parts of acrylonitrile, 39 parts of acrylic acid, 13 parts of dimethylaminopropylmethacrylamide, 80 parts of dimethylformamide and 20 parts of acetone were heated to 85° C., and 4 parts of AIBN were added in 4 portions in the course of 60 minutes. Polymerization was continued for one hour, after which the mass was cooled and then dissolved in a mixture of 332 parts of water and 30 parts of $NH_3$. A solution with a solids content of 22.6% was obtained.

The resulting tanning agent was employed as described in Example 2, and a deeply dyed leather was obtained.

EXAMPLE 15

In a reaction vessel equipped with a reflux condenser and a stirrer, 20 parts of acrylonitrile, 18 parts of dimethylaminopropylmethacrylamide, 27 parts of acrylic acid, 80 parts of dimethylformamide and 20 parts of acetone were heated to 85° C., and 4 parts of AIBN were added in 4 portions in the course of 60 minutes. Polymerization was continued for one hour, after which the mass was cooled and then dissolved in a mixture of 356 parts of water and 30 parts of $NH_3$. A solution with a solids content of 15.8% was obtained.

The resulting tanning agent was employed as described in Example 2, and a very deeply dyed leather was obtained.

EXAMPLE 16

As described in Example 1, 60 parts of acrylonitrile, 27 parts of acrylic acid and 23.5 parts of methacrylamidopropyltrimethylammonium chloride in 80 parts of dimethylformamide and 20 parts of acetone were polymerized in a reaction vessel by means of AIBN, and the product was dissolved in water and $NH_3$. This solution was used similarly to Example 2, and the leather thus obtained was found to be dyed in a full shade.

EXAMPLE 17

In a reaction vessel equipped with a stirrer and a reflux condenser, three portions, each comprising one part, of AIBN were added at intervals of 60 minutes to 52 parts of styrene and 49 parts of maleic anhydride in 200 parts of dimethylformamide at 85° C., while stirring. Polymerization was continued for a further 2 hours, after which the mixture was cooled to 25° C.

A mixture of 21.5 parts of dimethylaminopropylamine and 36.7 parts of dibutylamine was added to the solution thus obtained. The mixture was heated for two hours at 85° C. and then dissolved in 1,500 parts of water and 30 parts of $NH_3$. The resulting tanning agent was employed as described in Example 2, and a very deeply dyed leather was obtained.

EXAMPLE 18

The entire solution of the styrene/maleic anhydride copolymer in dimethylformamide obtained in Example 17 was cooled to 25° C., and a mixture of 24.3 parts of dimethylaminopropylamine and 46 parts of 2-ethylhexylamine was added. The mixture was heated at 85° C. for two hours and then dissolved in 1,500 parts of water and 20 parts of $NH_3$.

The resulting tanning agent was employed as described in Example 2, and a very deeply dyed leather was obtained.

EXAMPLE 19

The solution of the styrene/maleic anhydride copolymer in dimethylformamide obtained in Example 17 was cooled to 25° C., and a mixture of 17 parts of dibutylamine, 28 parts of diethylaminoethylamine and 10 parts of diethylamine was added. The mixture was heated at 85° C. for two hours and then dissolved in 500 parts of water and 30 parts of $NH_3$.

This solution was used similarly to Example 2, and the leather thus obtained was found to be dyed in a full shade.

EXAMPLE 20

The solution of the styrene/maleic anhydride copolymer in dimethylformamide obtained in Example 17 was cooled to 25° C., and a mixture of 34 parts of diethylaminobutylamine, 17 parts of dibutylamine and 10 parts of diethylamine was added. The mixture was heated at 85° C. for two hours and then dissolved in 500 parts of water and 30 parts of $NH_3$.

This solution was used similarly to Example 2, and the leather thus obtained was found to be dyed in a full shade.

EXAMPLE 21

The solution of the styrene/maleic anhydride copolymer in dimethylformamide obtained in Example 17 was cooled to 25° C., and a mixture of 38 parts of 1-diethylamino-4-aminopentane, 17 parts of dibutylamine and 10 parts of diethylamine was added. The mixture was heated at 85° C. for two hours and then dissolved in 500 parts of water and 30 parts of $NH_3$.

This solution was used similarly to Example 2, and the leather thus obtained was found to be dyed in a full shade.

EXAMPLE 22

The solution of the styrene/maleic anhydride copolymer in dimethylformamide obtained in Example 17 was cooled to 25° C., and a mixture of 31 parts of dimethylaminoneopentylamine and 39 parts of dibutylamine was added. The mixture was heated at 85° C. for two hours and then dissolved in 1,500 parts of water and 30 parts of $NH_3$.

This solution was used similarly to Example 2, and the leather thus obtained was found to be dyed in a full shade.

EXAMPLE 23

The solution of the styrene/maleic anhydride copolymer in dimethylformamide obtained in Example 17 was cooled to 25° C., and a mixture of 41 parts of 2-dibutylaminoethylamine and 29 parts of dibutylamine was added. The mixture was heated at 85° C. for two hours and then dissolved in 2,500 parts of water and 30 parts of $NH_3$.

The tanning agent obtained was employed as described in Example 2, and a deeply dyed leather was obtained.

EXAMPLE 24

The solution of the styrene/maleic anhydride copolymer in dimethylformamide obtained in Example 17 was cooled to 25° C., and a mixture of 41 parts of 2-dibutylaminoethylamine, 17 parts of dibutylamine and 10 parts of diethylamine was added. The mixture was heated at 85° C. for two hours and then dissolved in 500 parts of water and 30 parts of $NH_3$.

This solution was used similarly to Example 2, and the leather thus obtained was found to be dyed in a full shade.

EXAMPLE 25

The solution of the styrene/maleic anhydride copolymer in dimethylformamide obtained in Example 17 was cooled to 25° C., and a mixture of 24 parts of dimethylaminopropylamine and 22 parts of butanol was added. The mixture was heated at 85° C. for two hours and then dissolved in 500 parts of water and 30 parts of $NH_3$.

This solution was used similarly to Example 2, and a deeply dyed leather was obtained.

EXAMPLE 26

In a reaction vessel equipped with a stirrer and a reflux condenser, one part of AIBN was added every 2 hours to 52 parts of styrene and 49 parts of maleic anhydride in 200 parts of acetone at 65° C., while stirring. After a total polymerization time of 8 hours, the mixture was cooled.

The solution thus obtained was cooled to 25° C., and a mixture of 21.5 parts of dimethylaminopropylamine and 20.8 parts of isobutylamine was added. The mixture was heated at 85° C. for two hours and then dissolved in 1,500 parts of water and 30 parts of $NH_3$.

The tanning agent obtained was employed as described in Example 2, and a deeply dyed leather was obtained.

EXAMPLE 27

The solution of the styrene/maleic anhydride copolymer in dimethylformamide obtained in Example 17 was cooled to 25° C., and a mixture of 25 parts of dimethylaminopropanol and 32 parts of dibutylamine was added. The mixture was heated at 85° C. for two hours and then dissolved in 1,500 parts of water and 30 parts of $NH_3$.

This solution was used similarly to Example 2, and the leather thus obtained was found to be dyed in a full shade.

We claim:

1. A process for retanning previously mineral-tanned leather comprising treating said tanned leather with a tanning agent comprising an aqueous solution containing from 0.025 to 2.5% by weight, based on shaved weight, of a water-soluble amino- and carboxyl-containing polymer of a Fikentscher K value of 20 to 60, said polymer containing from 12 to 30% by weight, based on the total polymer, of carboxyl groups and a ratio of tertiary amino groups to carboxyl groups of from 1:8 to 1:2, said polymer being prepared by copolymerization of a carboxyl-containing monomer selected from the group consisting of acrylic acid and methacrylic acid, with dimethylaminopropyl methacrylamide and a nonionic comonomer selected from the group consisting of acrylonitrile and acrylamide, said treatment being at a liquor ratio of from 30 to 300%, based on shaved weight, at a pH of from 3.5 to 6, and at from 10° to 70° C.

* * * * *